US012540512B2

(12) United States Patent
Campbell et al.

(10) Patent No.: US 12,540,512 B2
(45) Date of Patent: Feb. 3, 2026

(54) APPARATUS AND METHOD FOR CREATING TUNABLE PRESSURE PULSE

(71) Applicant: Charles Abernethy Anderson, Millarville (CA)

(72) Inventors: Josh Campbell, Calgary (CA); Christian Fay, Calgary (CA)

(73) Assignee: Charles Abernethy Anderson, Millarville (CA)

( * ) Notice: Subject to any disclaimer, the term of this patent is extended or adjusted under 35 U.S.C. 154(b) by 219 days.

(21) Appl. No.: 18/249,015

(22) PCT Filed: Oct. 25, 2021

(86) PCT No.: PCT/CA2021/051496
§ 371 (c)(1),
(2) Date: Apr. 13, 2023

(87) PCT Pub. No.: WO2022/087721
PCT Pub. Date: May 5, 2022

(65) Prior Publication Data

US 2023/0383606 A1 Nov. 30, 2023

Related U.S. Application Data

(60) Provisional application No. 63/105,485, filed on Oct. 26, 2020.

(51) Int. Cl.
*E21B 7/24* (2006.01)

(52) U.S. Cl.
CPC ..... *E21B 7/24* (2013.01)

(58) Field of Classification Search
CPC ..... E21B 7/24; E21B 7/068
See application file for complete search history.

(56) References Cited

U.S. PATENT DOCUMENTS

| | | | | |
|---|---|---|---|---|
| 6,439,318 | B1 | 8/2002 | Eddison et al. | |
| 9,222,312 | B2 | 12/2015 | Anderson | |
| 9,382,760 | B2 | 7/2016 | Le et al. | |
| 10,465,464 | B2 | 11/2019 | Campbell | |
| 2013/0199848 | A1* | 8/2013 | Gust | E21B 7/24 175/56 |
| 2017/0191325 | A1* | 7/2017 | Campbell | E21B 4/02 |
| 2020/0056436 | A1* | 2/2020 | Roseman | E21B 21/103 |
| 2021/0301596 | A1* | 9/2021 | Schultz | E21B 21/08 |

OTHER PUBLICATIONS

International Searching Authority, U.S. Patent and Trademark Office, International Search Report and Written Opinion for PCT/CA2021/051496, mailed Jan. 21, 2022, 7 pages.

* cited by examiner

*Primary Examiner* — Theodore N Yao
(74) *Attorney, Agent, or Firm* — Holzer Patel Drennan

(57) ABSTRACT

Apparatus and methodologies herein relate to downhole tools capable of creating a vibration, and more particularly for creating and controllably adjusting tunable pressure pulses for imparting vibration to a downhole drill string. Various pressure pulse settings, and corresponding performance parameters, may be selected by controllably restricting fluid flow through the apparatus.

20 Claims, 14 Drawing Sheets

APPARATUS AND METHOD FOR CREATING TUNABLE PRESSURE PULSE

CROSS REFERENCE TO RELATED APPLICATION

The present application claims the benefit of priority to U.S. Patent Application No. 63/105,485 filed Oct. 26, 2020, which is specifically incorporated by reference herein for all that it discloses or teaches.

FIELD

Embodiments herein are generally related to downhole tools capable of creating a vibration (friction reduction), and more particularly to methods and apparatus for creating and optimizing tunable pressure pulses for imparting vibration to a downhole drill string.

BACKGROUND

Producers in the oil and gas industry access subsurface hydrocarbon-bearing formations by drilling long bore holes into the earth from the surface. Conventional drilling companies advance a rotating drill bit through the hole, the bit being mounted on a bottom hole assembly at the distal end of a drill string. During drilling, friction between the downhole assembly and the earth can impair the rate of penetration in the hole. Where highly deviated holes or horizontal holes are being drilled, the weight of the drill pipe alone cannot be relied upon to overcome friction from the string resting against the wall of the hole.

One means for overcoming downhole friction is to impart a vibration or movement to the drill string. For example, the "AG-itator" tool disclosed in U.S. Pat. No. 8,167,051 teaches the use of a 1:2 lobe Moineau principle positive displacement motor (PDM) to control a valve arrangement that oscillates in and out of alignment as the pump snakes back-and-forth. Oscillation of the valve arrangement causes an increase in fluid pressure as the valve closes, and a corresponding release of pressure as the valve opens, creating a pressure pulse capable of vibrating the string. The pressure pulse magnitude and frequency of such vibration tools, however, are limited by the tool design. Other conventional tools operate by creating backpressure in the fluid supply. These tools require supply pumps of greater capacity and also reduce the supply pressure to the drill bit.

U.S. Pat. No. 9,222,312 teaches a "Ratter" vibration tool that induces movement of the string by reducing the overall fluid pressure within the drill string, creating a negative pressure pulse. In the Rattler tool, drilling fluid is pumped down the drill string and then cyclically vented from the tool to the annulus through a fluid port disposed in the sidewall of the tool. The Rattler tool, however, teaches the use of a turbine-type rotor in the tool body, resulting in a limited size and frequency pressure pulse that can be achieved (that is—venting of fluid from the tool is limited to the available fluid pressure that can be vented, and the corresponding pressure drop directly correlate to the uncontrolled speed of the "spinning" turbine-type rotor).

U.S. Pat. No. 10,465,464 teaches a "Toe Tapper" vibration tool that generates a tunable negative pressure pulse by controllably restricting the fluid flowing through the tool to cause an increase in fluid pressure, e.g., by via fixed or variable fluid flow restrictor or valve arrangement, in combination with controllably venting fluid from the tool to create a pressure pulse. By controlling the pressure of unvented fluid flow through the tool, the Toe Tapper tool can significantly increase the magnitude of the pressure pulse created. In use, however, the Toe Tapper can be limited because operators are unable to modify fluid flow restriction through the tool, limiting the operator's ability to change or modify the pressure pulse once the tool has been assembled.

There remains a need for further improved downhole vibration tools that can be field-tunable to produce even larger amplitude pressure pulses to generate even more impact force.

SUMMARY

According to embodiments, an apparatus for inducing negative pressure pulses to a drilling-fluid transmitting downhole apparatus are provided, the apparatus being adapted to controllably vary the passage of the drilling fluid, wherein the apparatus may comprise a tubular housing having a cylindrical wall forming a central bore extending through the housing with an upper inlet end and a lower outlet end, and at least one fluid port disposed through the wall, a positive displacement motor, positioned within the bore of the housing, a fluid vent assembly, positioned within the bore of the housing, connected to and rotatable with the positive displacement motor, the fluid vent assembly having at least one second fluid port, at least one fluid flow restrictor, positioned within the bore of the housing, forming at least two fluid flow paths through the restrictor, and at least one fluid flow restrictor plug, slidably received within the fluid flow restrictor, for restricting fluid flow through at least one of the fluid flow paths to induce the negative pressure pulses.

In some embodiments, the at least one fluid flow restrictor plug of the present apparatus may be axially adjusted within the at least one fluid flow restrictor to restrict different predetermined volumes of fluid flow through at least one of the at least two fluid flow paths. For example, the at least one fluid flow restrictor plug may be axially adjusted between at least one 'open' setting, permitting a maximal amount of fluid flow through the at least one restrictor to at least one other 'closed' setting, restricting a maximal amount of fluid flow through the at least one restrictor. Axially adjusting the at least one fluid flow restrictor between the at least one settings may generate different, predetermined pressure pulse profiles depending upon the operating parameters.

In some embodiments, the at least one fluid flow restrictor plug of the present apparatus and methodologies may be adjusted to restrict fluid flow through one of the at least two fluid flow paths.

In some embodiments, the at least one fluid flow restrictor of the present apparatus and methodologies may comprise at least one rotating component and at least one stationary component, wherein the at least one rotating and stationary components form the at least two fluid flow paths. For example, the at least one rotating and stationary components and corresponding at least two fluid flow paths may rotate into and out of alignment.

According to embodiments, methods of inducing a negative pressure pulse to a drilling fluid transmitting downhole apparatus are provided, the methods comprising providing fluid flow through a positive displacement motor housed within the apparatus, providing at least one fluid flow restrictor having at least two fluid flow paths for controllably restricting the velocity of at least a portion of the fluid flow through the apparatus by passing the fluid flow through the at least one fluid flow restrictor, providing at least one fluid flow restrictor plug for restricting fluid flow through at least one of the fluid flow paths, increasing fluid pressure within the tool, while recurrently venting at least a portion of the restricted fluid from the downhole apparatus through a fluid vent assembly to induce the negative pressure pulse.

In some embodiments, the present methods may further comprise adjusting the at least one fluid flow restrictor plug to restrict different predetermined volumes of fluid flow through at least one of the at least two fluid flow paths.

In some embodiments, the present methods may further comprise adjusting the at least one fluid flow restrictor plug between at least one 'open' setting for permitting a maximal amount of fluid flow through the at least one restrictor, and at least one other 'closed' setting for restricting a maximal amount of fluid flow through the at least one restrictor. In some embodiments, adjusting of the at least one fluid flow restrictor plug may restrict fluid flow through one of the at least two fluid flow paths generating different pressure pulse profiles. The method of claim 12, wherein adjusting the at least one fluid flow restrictor plug restricts fluid flow through one of the at least two fluid flow paths.

In some embodiments, the restrictor of the present methods may comprise at least one rotary component that rotates into and out of alignment with at least one stationary component. In some embodiments, the at least one rotary and stationary components may form the at least two fluid flow paths.

According to the present methods, adjustment of the at least one fluid flow restrictor may controllably dictate the velocity of the fluid flowing through the at least one fluid flow restrictor. In some embodiments, the manner of fluid flow restriction and venting dictate the amplitude and frequency of the pressure pulse.

DETAILED DESCRIPTION OF THE PREFERRED EMBODIMENTS

Apparatus and methods herein describe means for achieving a tunable negative pressure pulse, i.e., a pulse in the negative direction, by controllably and progressively restricting the fluid flowing through the apparatus. Herein, the presently improved apparatus and methodologies comprise an improved valve arrangement in combination with the controlled, intermittent venting of the fluid therefrom. According to improved embodiments, the present apparatus and methodologies of use provide altered fluid flow geometry and enhanced fluid flow valve control for optimizing the achieved tunable negative pressure pulse, generating increased hydraulic impact and overall friction reduction.

According to embodiments, the present apparatus and methodologies may improve upon known pressure pulse tools and methods of use including the "Toe Tapper" tool as described in U.S. Pat. No. 10,465,464 (the '464 patent), incorporated by reference herein in its entirety. The apparatus and methods of use described in the '464 patent are first reproduced for establishing the basic principles of pressure pulse tools having a fluid vent assembly for controllably modifying the pressure of drilling fluid through the tool, and then embodiments of the current apparatus are introduced.

The '464 Patent

Figure 1:
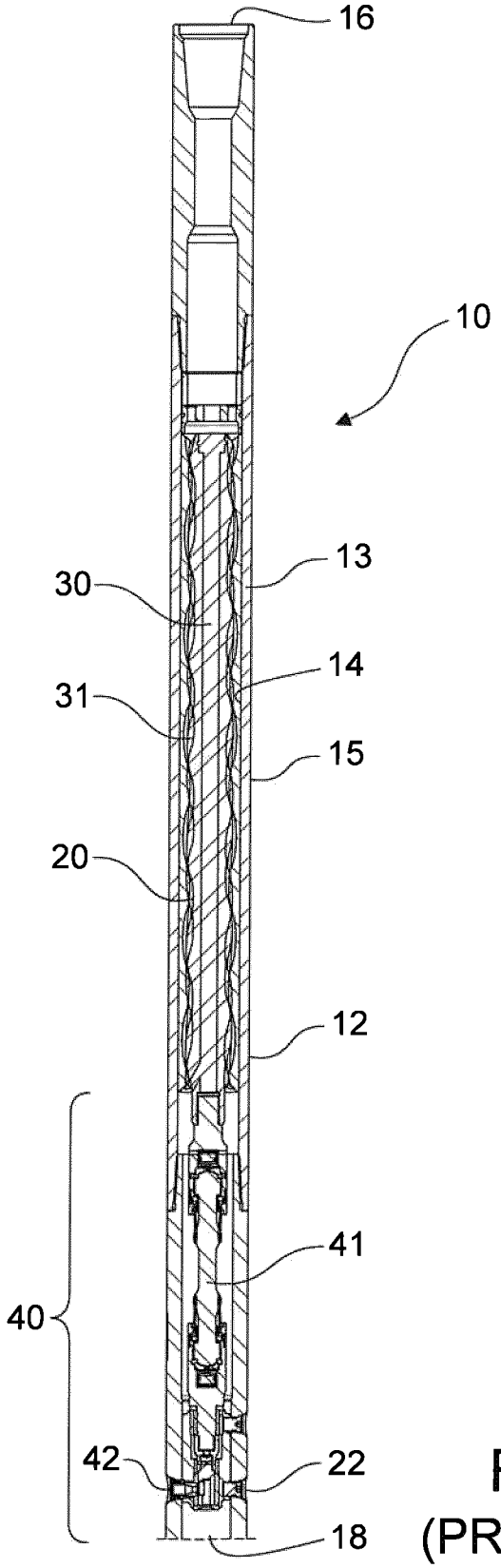
FIG. 1 (PRIOR ART)
FIG. 1 (PRIOR ART) is a cross sectional side view of an example apparatus for inducing negative pressure pulses known in the art.

Having regard to FIG. 1 (PRIOR ART), the vibration tool 10 disclosed in the '464 patent is configured to be incorporated into a drilling fluid-transmitting downhole apparatus (e.g., drill string, coil tubing, casing string, etc.) positioned within a subterranean bore hole. The tool 10 comprises a housing 12 adapted to permit the passage of drilling fluid therethrough, the housing 12 having a cylindrical wall 13 with inner and outer surfaces 14,15 extending between and upper (uphole) inlet end 16 and a lower (downhole) outlet end 18. The inlet and outlet ends 16,18 of the housing 12 can include interior and exterior threading for connecting the housing 12 with the drill string, as known in the art. Interior and exterior threading may be of conventional type, such as pin/box type to facilitate ready connection with the drill string. Housing 12 can be of steel construction, or any other suitable material, and can be surface hardened for durability and abrasion resistance.

Figure 2:
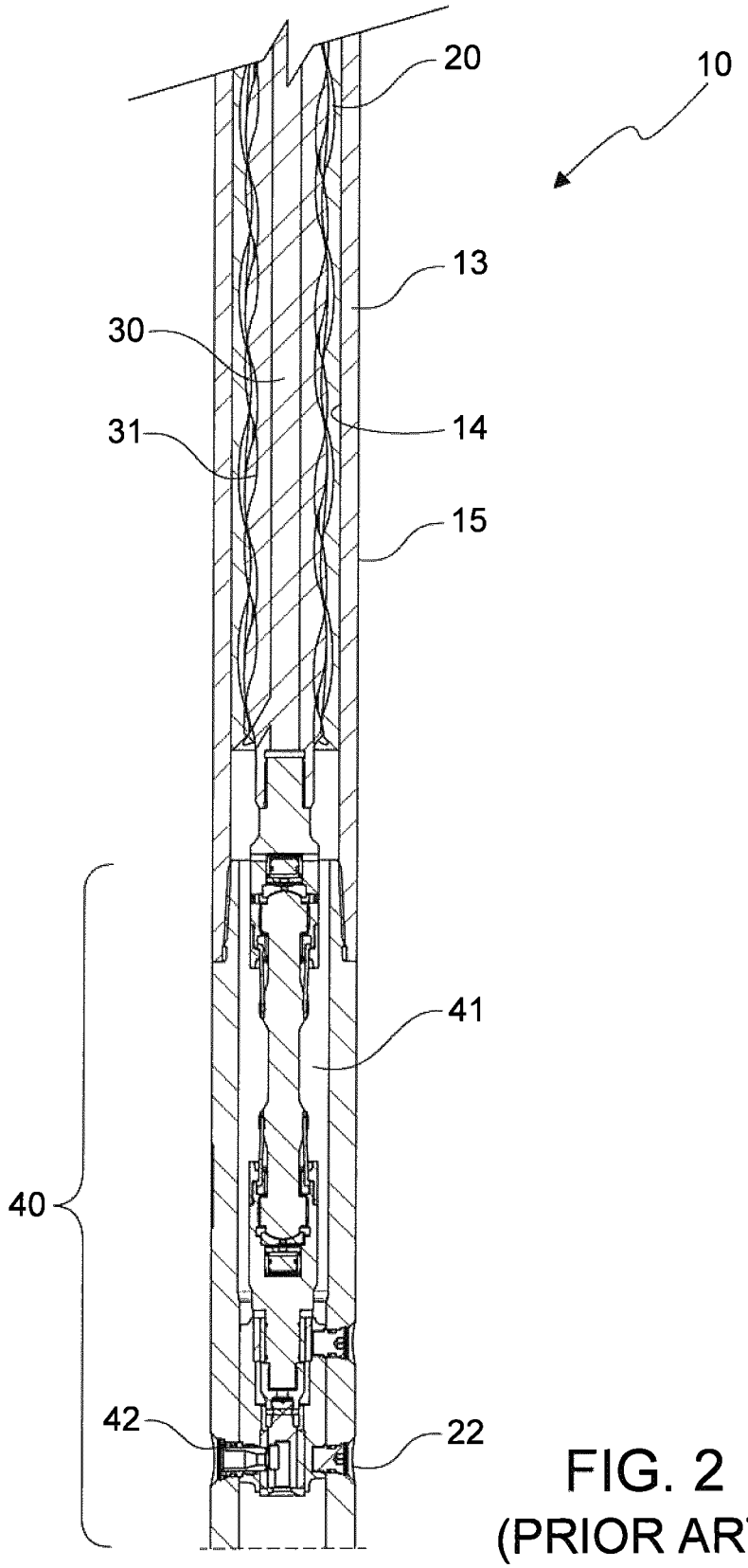
FIG. 2 (PRIOR ART)
FIG. 2 (PRIOR ART) is a magnified cross sectional side view of the apparatus shown in FIG. 1.

Having regard to FIG. 2 (PRIOR ART), housing 12 defines a central bore 20, and housing wall 13 forms at least one first fluid port 22, having a generally circular cross section, extending through the wall 13 from the central bore 20 to the annulus. It is contemplated that fluid port 22 may be configured to optionally receive fluid inserts (not shown), altering the diameter thereof, as desired.

Housing 12 is configured to receive drive means (e.g., a mud motor) within bore 20 for pumping drilling fluid received from the drill string downwards through the tool 10. While it is understood that any suitable drive means can be used, embodiments herein illustrate the use of a positive displacement pump 30 having a rotor 31.

Housing 12 is further configured to receive a fluid vent assembly 40 within bore 20, the vent assembly 40 comprising a body 41 affixed to the lower end of the pump 30 and movable therewith (e.g., in the case of the positive displacement pump 30, vent assembly 40 can be rotatable therewith). Fluid vent assembly 40 forms at least one second fluid port 42, corresponding with first fluid port 22 of housing 12, such that when first and second fluid ports 22,42 are in alignment, fluid can be vented from the tool 10 to the annular space between the tool 10 and the borehole. For example, in the case of a rotating fluid vent assembly 40, as body 41 rotates within central bore 20, first fluid port 22 revolves in and out of alignment with second fluid port 42, each cyclical alignment causing at least a portion of the drilling fluid passing through the tool 10 to be vented to the annular space. It is understood that second fluid port 42, and ultimately the venting window formed by ports 22,42 can be configured in any manner with any internal diameter size or shape to further control the pressure pulse profile.

More specifically, in operation, the rate of drilling fluid flow through the tool 10 is determined by the rate of the pump 30 and thus remains constant. The velocity of said fluid flow through the tool, however, can be dictated according to predetermined and desired pressure pulse profiling. For example, as fluid ports 22,42 rotate in and out of alignment, fluid pressure within the tool 10 increases until ports 22,42 align again and at least a portion of the pressurized fluid is released from the tool 10. This "venting" of fluid from the tool 10 to the annular space outside of the tool 10 provides for a means of creating pressure pulse (or vibration) while maintaining a constant fluid flow rate through tool 10 and regardless of the downstream pressure.

Although the venting of fluid from the tool 10 alone provides a nominal pressure drop, it was determined that further modifying the velocity of the fluid flow through the tool 10 (e.g., via fixed or variable fluid restriction) in combination with the venting enabled the dictation of pressure pulse profiles to allow for controlled tenability of pulse frequency, pulse profile (e.g., sharp or gradual pulses) and significantly greater pulse intensity.

More specifically, in operation, in addition to the recurrent venting of fluid from the tool 10, the velocity of at least a portion of the unvented fluid flowing through the tool 10 can be restricted in a fixed or variable manner, providing a larger release of fluid pressure upon venting of fluid from the tool 10 (that is—providing a larger pressure release in the negative direction upon venting from the tool). This increased pressure is again achieved without the need to alter the fluid flow rate through the tool, and regardless of the downstream pressure.

Figure 3:
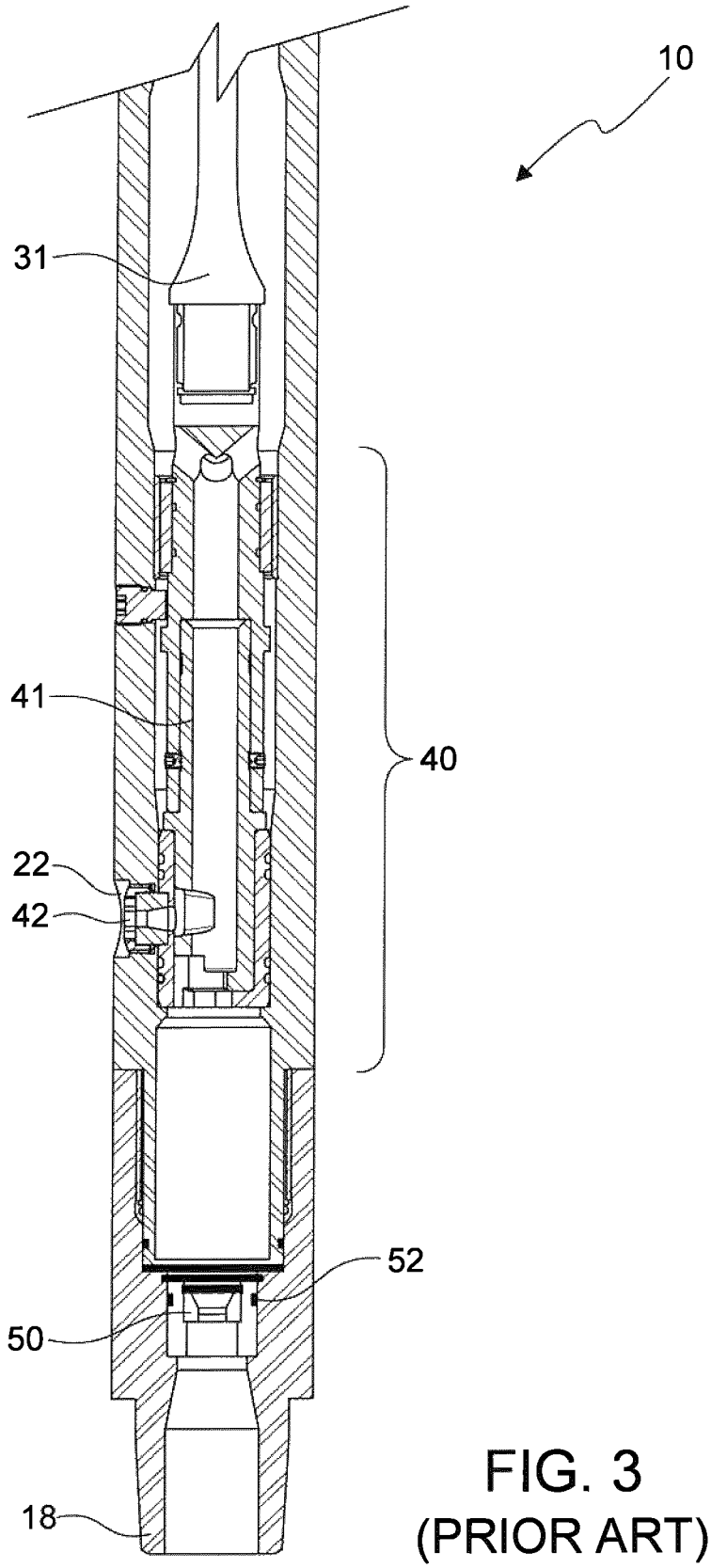
FIG. 3 (PRIOR ART)
FIG. 3 (PRIOR ART) is a cross sectional side view of the apparatus shown in FIG. 1, the apparatus having a fluid flow restrictor.

In one embodiment, fluid flow through the tool 10 may be modified by controlling the velocity of fluid passing through outlet end 18 of the tool. For example, having regard to FIG. 3 (PRIOR ART), a fixed or variable fluid flow restrictor 50 can be provided downstream of vent assembly 40 for restricting at least a portion of the unvented fluid flowing through the tool 10. It is contemplated that one or more fluid flow restrictors 50 may be positioned upstream, within (e.g., substantially adjacent), or downstream of fluid vent assembly 40.

In some embodiments, fluid flow restrictor 50 may be a fixed restrictor such as, for example, a fluid port 52 having a known, predetermined shape and constant fluid flow area (i.e., internal diameter). Without limitation, fluid flow area of fluid flow restrictor 50 can be limited only by the internal diameter of the downhole apparatus as a maximum and allowing fluid flow through the tool 10 as a minimum. Fixed fluid flow restrictor 50 may be configured according to the desired pressure pulse profile.

In other embodiments, fluid flow restrictor 50 may be variable in size and shape according to the predetermined pressure pulse profile such as, without limitation, a valve arrangement including a rotating, axially oscillating, or orbiting valve arrangement (or other suitable arrangement, e.g., intersecting venting windows). It is understood that any fluid flow restriction arrangement capable of achieving the desired control of fluid velocity may be used. Any restrictor arrangement having an eccentric running surface that can be used to allow fluid flow to be vented when the eccentric surface is orbiting off the fluid restrictor can be used.

Current Embodiments

Depending upon the drilling operations, however, pressure pulses generated by the known pressure pulse tools 10 can be limited by the specific, predetermined configuration of fluid flow restrictor 50 used. For example, although the fluid flow restrictor 50 can be selected according to its size and shape before the tool 10 is assembled, once the restrictor 50 is positioned within the tool 10 it cannot thereafter be modified without having to completely dismantle and reassemble the tool 10. In other words, once the operator selects a particular restrictor 50, the tool is limited to the pressure pulse induced by the selected restrictor 50. There remains a need for further improved downhole vibration tools that can be field-tunable on site by the operator to produce even larger amplitude pressure pulses with even more impact force.

Herein, improved apparatus and methodologies of pressure pulse tools 10 that can be modified for use in different drilling operations are provided, wherein the tool 10 may provide an adjustable fluid flow geometry allowing the operator to optimize the pressure pulses in the field. In some embodiments, the presently improved apparatus and methodologies may be field-tunable between a plurality of operational settings depending upon the particular drilling parameters.

The presently modified apparatus and methodologies of use will now be described having regard to FIGS. 4-10. Reference numerals of the components herein are the same as assigned for like components of the '464 patent and new reference numerals are provided for differing components.

According to embodiments, apparatus and methodologies provided herein comprise an improved pressure pulse tool 10 that is adaptable for use in different drilling operations, the tool 10 having improved fluid flow geometry to generate optimized pressure pulses. In some embodiments, the pressure pulse profile achieved by the present tool 10 may be controllably varied to alter the amplitude and frequency of the pulse (e.g., to create sharp or gradual vibration), whether the tool 10 is operable in one downhole application or adapted for use in different applications. For example, the pressure pulse profile achieved by the presently improved tool 10 may be progressively varied to achieve a larger pressure pulse impulse.

Figure 4:
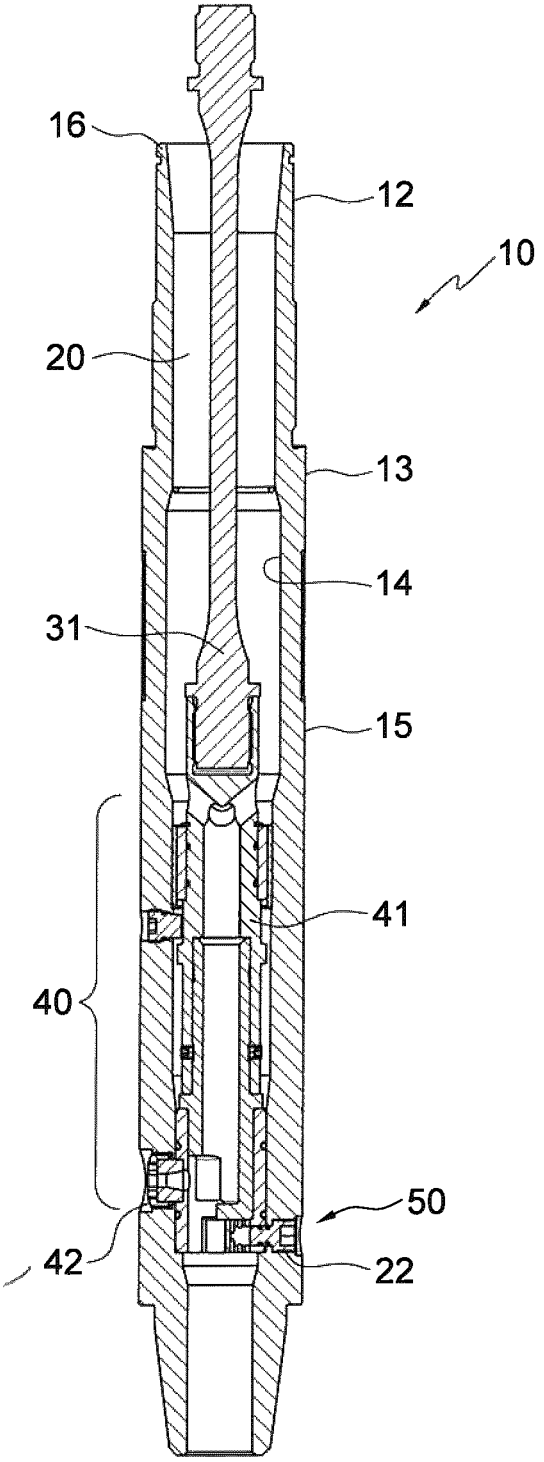
FIG. 4 is a cross sectional side view of the presently improved apparatus, according to embodiments.

Having regard to FIG. 4, the presently improved tool 10 comprises a housing 12 adapted to permit the passage of drilling fluid therethrough, the housing 12 having a cylindrical sidewall 13 with inner and outer surfaces 14,15 extending between and upper (uphole) inlet end 16 and a lower (downhole) outlet end 18. The inlet and outlet ends 16,18 of the housing 12 can include interior and exterior threading for connecting the housing 12 with the drill string, as known in the art. Interior and exterior threading may be of conventional type, such as pin/box type to facilitate ready connection with the drill string. Housing 12 can be of steel construction, or any other suitable material, and can be surface hardened for durability and abrasion resistance.

Housing 12 defines a central bore 20, and housing sidewall 13 forms at least one first fluid port 22, having a generally circular cross section, extending through the wall 13 from the central bore 20 to the annulus. It is contemplated that fluid port 22 may be configured to optionally receive fluid inserts (not shown), altering the diameter thereof, as desired.

Housing 12 is configured to receive drive means (e.g., a mud motor) within bore 20 for pumping drilling fluid received from the drill string downwards through the tool 10. While it is understood that any suitable drive means can be used, embodiments herein illustrate the use of a positive displacement pump having a rotor 31.

Housing 12 is further configured to receive a fluid vent assembly 40 within bore 20, the vent assembly 40 comprising a body 41 affixed to the lower end of the pump and movable, i.e., rotatable, therewith. For example, in the case of a positive displacement pump, vent assembly 40 may be operably connected to and rotatable with rotor 31. An upper (uphole) end of body 41 can include exterior threading for threadably connecting body 41 with rotor 31, as known in the art. Interior and exterior threading may be of conventional type, such as pin/box type to facilitate ready connection with the fluid vent assembly 40.

Fluid vent assembly 40 may form at least one second fluid port 42, corresponding with first fluid port 22 of housing 12, such that when first and second fluid ports 22,42 are in alignment, fluid can be vented from the tool 10 to the annular space between the tool 10 and the borehole. For example, in the case of a rotating fluid vent assembly 40, as rotor 31 rotates, body 41 correspondingly rotates therewith causing first fluid port 22 to revolve into and out of alignment with second fluid port 42. During each cyclical alignment of ports 22,42, at least a portion of the drilling fluid passing through bore 20 of housing 12 is vented through sidewall 13 into the annular space. It is understood that second fluid port 42, and ultimately the venting window formed by ports 22,42 can be configured in any manner with any internal diameter size or shape to further control the pressure pulse profile.

As above, in operation, the rate of drilling fluid flow through the tool 10 is determined by the rate of the pump 30 and thus remains constant. The velocity of said fluid flow through the tool 10, however, can be dictated according to predetermined and desired pressure pulse profiling. For example, as fluid ports 22,42 rotate in and out of alignment, fluid pressure within the tool 10 can be controllably increased until ports 22,42 align again and at least a portion of the pressurized fluid is released from the tool 10. This "venting" of fluid from the tool 10 to the annular space outside of the tool 10 creates a pressure pulse or vibration of the tool 10 while maintaining a constant fluid flow rate through tool 10 regardless of the downstream pressure.

As also above, although the venting of fluid from the tool 10 alone provides a nominal pressure drop, modifying the velocity of the fluid flow through the tool 10, via variable restriction of the fluid flow, can further dictate the pressure pulse profiles and allow for controlled tenability of pulse frequency, pulse profile, and significantly greater pulse intensity. Herein, the restriction of fluid flowing through the tool 10 can be controllably and progressively varied to achieve a larger pressure pulse impulse and to produce a greater amplitude pulse for the same pressure drop as well as enhanced impact force.

More specifically, in operation, in addition to the recurrent venting of fluid from the tool 10, the velocity of at least a portion of the unvented fluid flowing through the tool 10 can be restricted in a variable manner, providing a larger release of fluid pressure upon venting of fluid from the tool 10 (that is—providing a larger pressure release in the negative direction upon venting from the tool). This increased pressure is again achieved without the need to alter the fluid flow rate through the tool 10 and regardless of the downstream pressure.

More specifically, fluid flow through the tool 10 may be modified by controlling the velocity of fluid passing through outlet end 18 of the tool. For example, having further regard to FIG. 4, at least one fluid flow restrictor 50, positioned within the bore 20 of the housing 12, can be provided. Fluid flow restrictor 50 may be positioned downstream of vent assembly 40 for restricting at least a portion of the 'unvented' fluid flowing through the tool 10, however it is contemplated that one or more fluid flow restrictors 50 may be positioned upstream, within (e.g., substantially adjacent), or downstream of fluid vent assembly 40.

Figure 5:
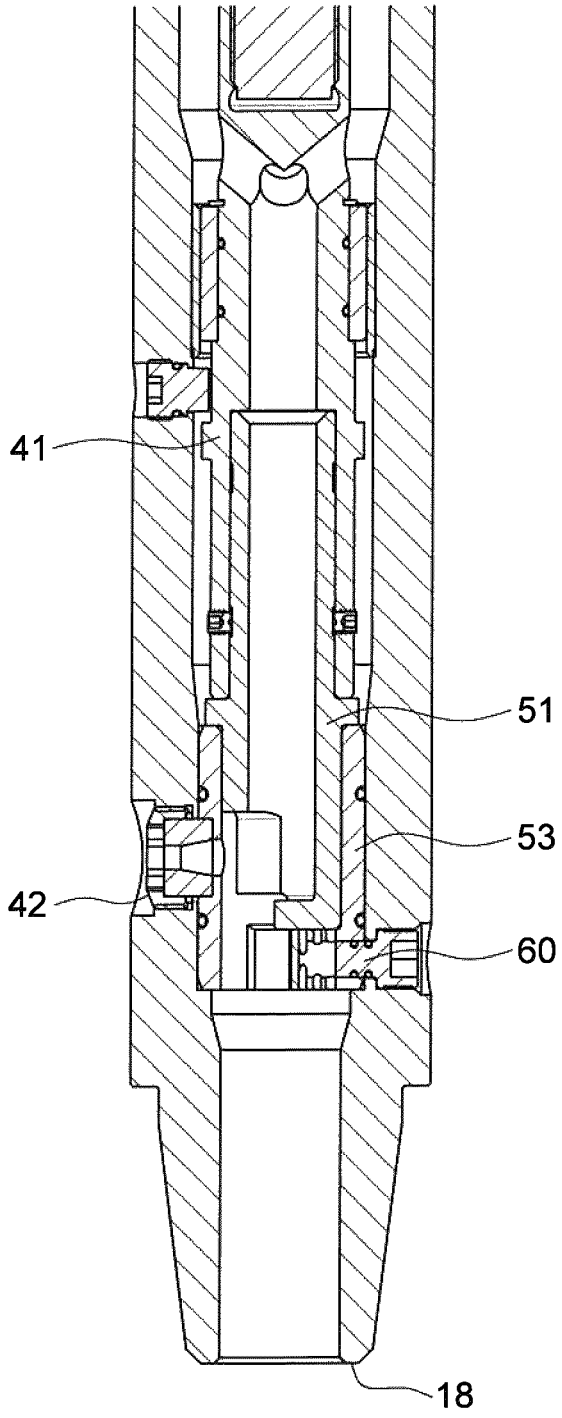
FIG. 5 is a zoomed in cross sectional side view of the apparatus shown in FIG. 4, according to embodiments.

As shown in FIG. 5, in some embodiments, fluid flow restrictor 50 may be variable in size and shape and may be selected based upon the predetermined pressure pulse profile desired. Fluid flow restrictor 50 may comprise, without limitation, a valve arrangement including a rotating, an axially oscillating, an orbiting valve arrangement, or other suitable arrangement, e.g., intersecting venting windows. It is understood that any fluid flow restriction arrangement capable of achieving the desired control of fluid velocity may be used. Any restrictor arrangement having an eccentric running surface that can be used to allow fluid flow to be vented when the eccentric surface is orbiting off the fluid restrictor can be used.

Herein, as will be described, the at least one fluid flow restrictor 50 may form at least two fluid flow paths. In some embodiments, the one or more fluid flow paths may be controllably plugged in order to restrict more or less of the fluid flowing through the tool 10, i.e., to increase or decrease cross-sectional space the fluid may pass through, thereby increasing or decreasing the velocity of the fluid flowing through tool 10. Advantageously, based upon the desired pressure pulse profile, an operator may select one or more settings of operation, each setting restricting a different volume of fluid flowing through the tool. That is, in operation, the tool 10 may be adapted from a first 'open' setting, where minimal fluid flow is restricted and a first pressure pulse profile is achieved, to any number of other settings including a second 'closed' setting, where maximal fluid flow is restricted, and a second pressure pulse profile is achieved. Although the present tool 10 is described having four operational settings, any number of fluid flow restriction settings may be provided.

For example, having further regard to FIG. 5, in some embodiments, fluid flow restrictor 50 may further comprise at least one fluid flow restrictor pin or plug 60, the plug 60 being adjustable between a plurality of settings where for each setting plug 60 serves to restrict a different volume of fluid flow through flow restrictor 50 to achieve different, modifiable performance levels. In this manner, the pressure pulse profile achieved by the presently improved tool 10 may be 'field-tunable' such that, on-site and depending upon operating parameters, an operator can select from a plurality of predetermined performance level settings by selecting the appropriate restrictor plug 60 to switch the tool 10 from one fluid flow restriction setting to another. Depending upon the flow restrictor plug 60 selected, the presently improved tool 10 may be adjustably tuned at surface.

According to embodiments, for example, the presently improved tool 10 may be tunable such that an operator may select from a plurality of tool performance settings, such as at least four different performance level settings, each setting being determined on location to provide the operator with more definitive tool control.

Figure 6A:
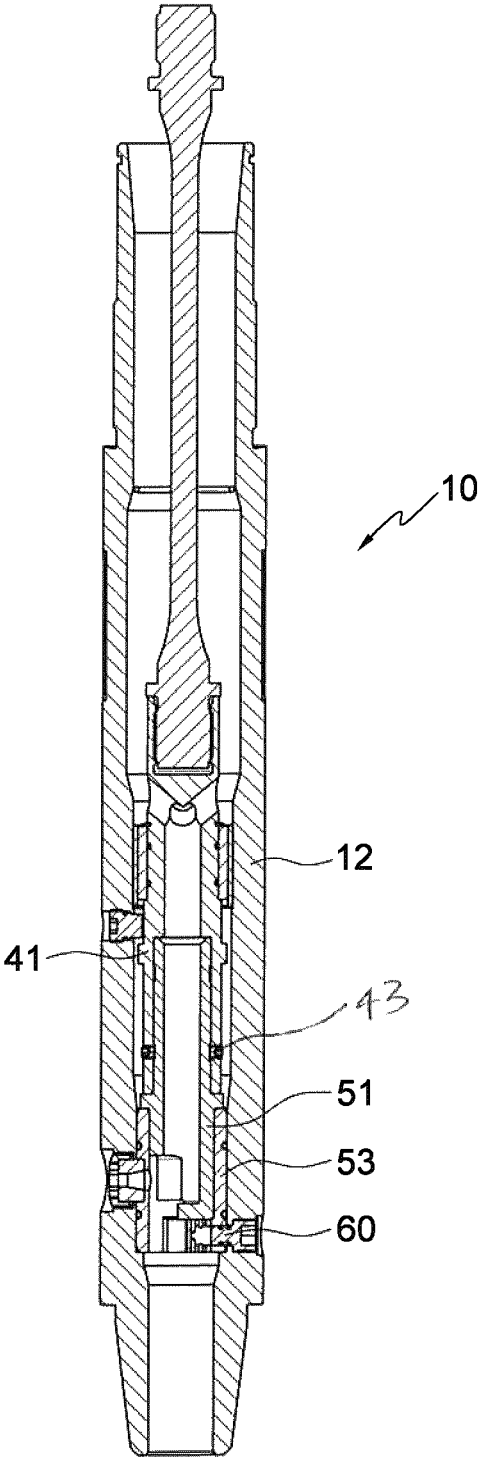
FIG. 6A is a cross sectional side view of the presently improved apparatus, the fluid flow restrictor configured for a first 'open' setting of fluid flow restriction, according to embodiments.
Figure 6B:
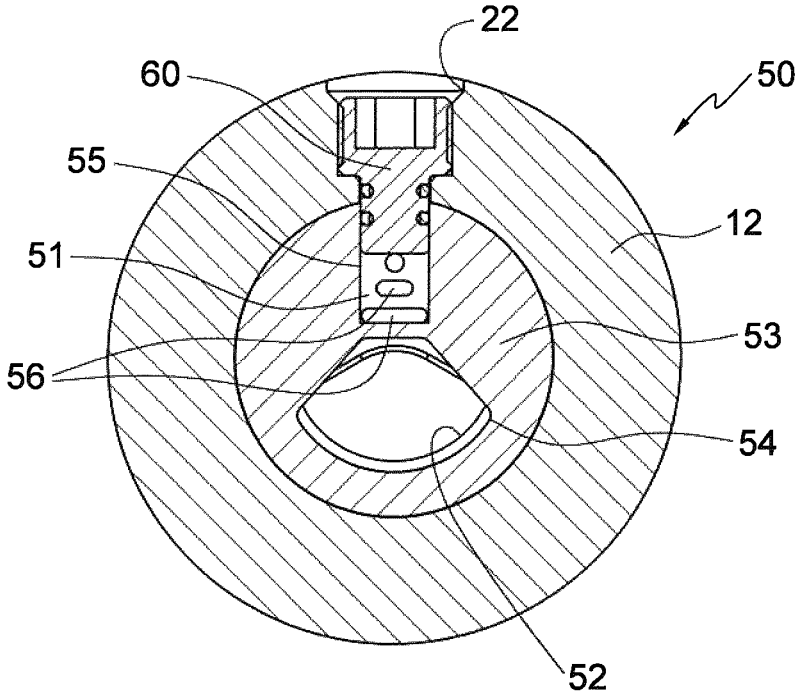
FIG. 6B is a top down cross sectional view of the fluid flow restrictor shown in 6A, according to embodiments.

More specifically, having regard to FIGS. 6A and 6B, fluid flow restrictor 50 may comprise a fluid control valve providing at least two fluid flow paths. In some embodiments, fluid flow restrictor 50 may comprise a rotating valve, such as a rotating disc valve, having at least one rotating component 51 and at least one stationary component 53, although it is contemplated that both valve components may rotate relative to each other and/or relative to housing 12.

In some embodiments, rotating component 51 may be operatively connected to, and rotatable with, body 41 of vent assembly 40, while stationary component 53 may operably connected to, or sealingly positioned within, housing 12. For example, rotating component 51 may be slidably received within a lower end of body 41 and may include exterior threading for connecting thereto. Threading may be of conventional type, such as pin/box type to facilitate ready connection between rotating element 51 and body 41, and one or more bearing assemblies 43 may be operationally positioned therebetween.

Each rotating and stationary components 51,53 may form at least one first fluid flow path through restrictor 50 for controllably restricting the passage of fluid flowing through restrictor 50 positioned with bore 20 of housing 12. For example, having specific regard to FIG. 6B, rotating component 51 may form at least one centrally disposed opening or aperture 52, and stationary disc 53 may form at least one centrally disposed opening or window 54.

As rotating disc 51 rotates relative to stationary disc 53, aperture and window 52,54 pass into and out of alignment in relation to each other. When aligned, at least a portion of a controlled volume of fluid may pass therethrough. When misaligned, at least a portion of a controlled volume of fluid is restricted from passing therethrough. In this manner, aperture and window, 52,54, may correspond to form the at least one first fluid flow path through restrictor 50 and may be sized and shaped as desired to achieve the desired control of fluid velocity through tool 10.

Each rotating and stationary components 51,53 may also form at least one second fluid flow path through restrictor 50 for enhancing the controlled restriction of the passage of fluid flowing through restrictor 50. For example, as shown in FIG. 6B, rotating disc 51 may also form at least one radially extending hole 56, and stationary disc 53 may also form at least one channel. In some embodiments, rotating holes 56 may be sized and shaped so as to generally correspond with stationary groove 55.

As rotating disc 51 rotates relative to stationary disc 53, holes 56 pass into and out of alignment in relation to groove 55. When aligned, at least a portion of a controlled volume of fluid may pass therethrough. When misaligned, at least a portion of a control volume of fluid is restricted from passing therethrough. In this manner, groove and holes 55,56 may correspond to form the at least one second fluid flow path through restrictor 50 and may be sized and shaped as desired to achieve the desired control of fluid velocity through tool 10.

As above, fluid flow restrictor 50 further comprises at least one fluid flow restrictor pin or plug 60, the plug 60 being adjustable between a plurality of settings where for each setting plug 60 serves to restrict a different volume of fluid flow through flow restrictor 50 to achieve different, modifiable performance levels. Having regard to FIG. 6B, plug 60 may be slidably received within groove 55 and operative to restrict at least a portion of the fluid flowing through the at least one second fluid flow path.

More specifically, as will be described, by adjusting the longitudinal back and forth axial positioning of the at least one plug 60 within groove 55, an operator may controllably restrict different volumes of fluid flow through flow restrictor 50 to achieve different performance levels. By varying fluid flow passing through at least one flow path formed by restrictor 50, in combination with the controlled venting of fluid from the tool 10, the operator can generate tool vibrations having varied frequencies and intensities.

Figure 7A:
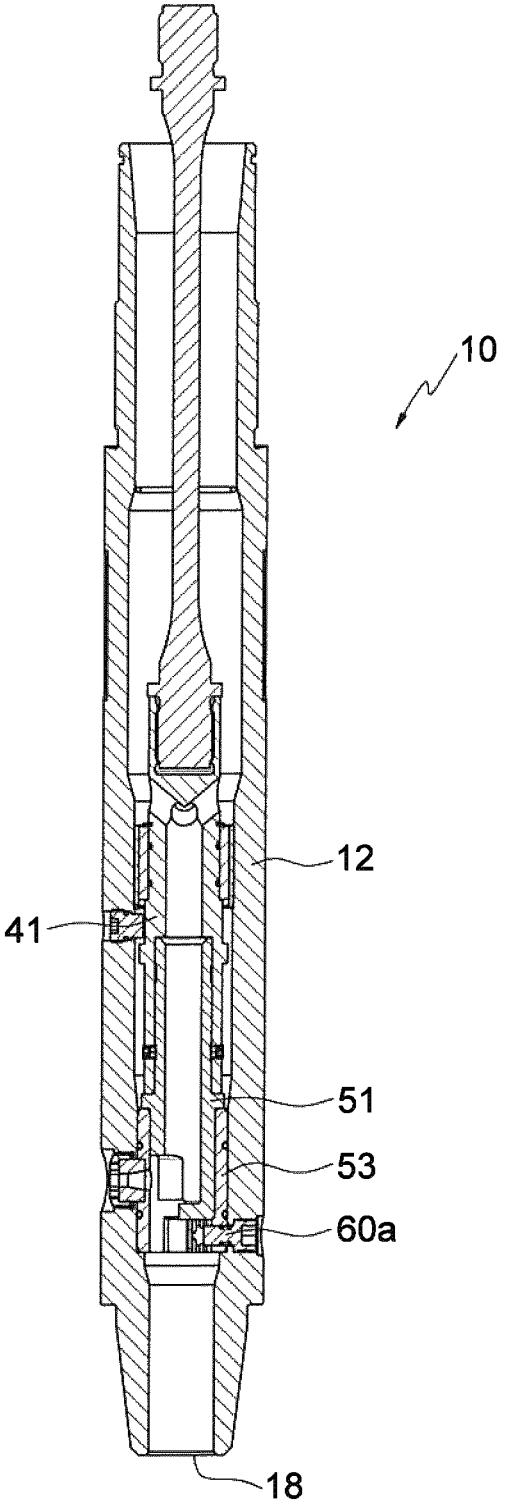
FIG. 7A is a cross sectional side view of the presently improved apparatus and methodologies, the fluid flow restrictor configured for a second setting of fluid flow restriction, according to embodiments.
Figure 7B:
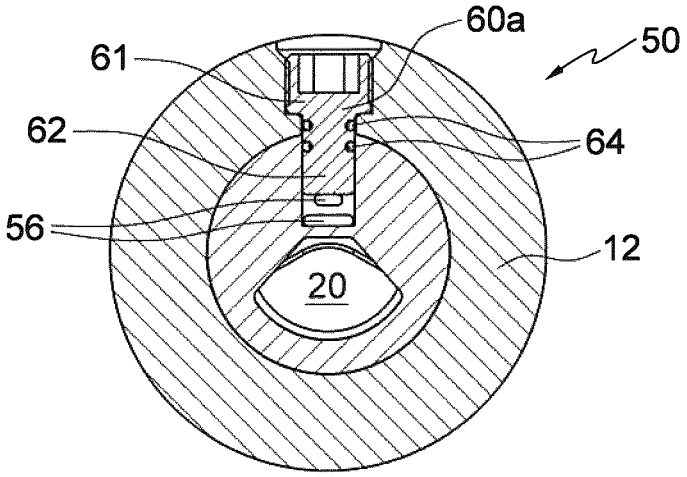
FIG. 7B is a top down cross sectional view of the fluid flow restrictor shown in 7A, according to embodiments.
Figure 8A:
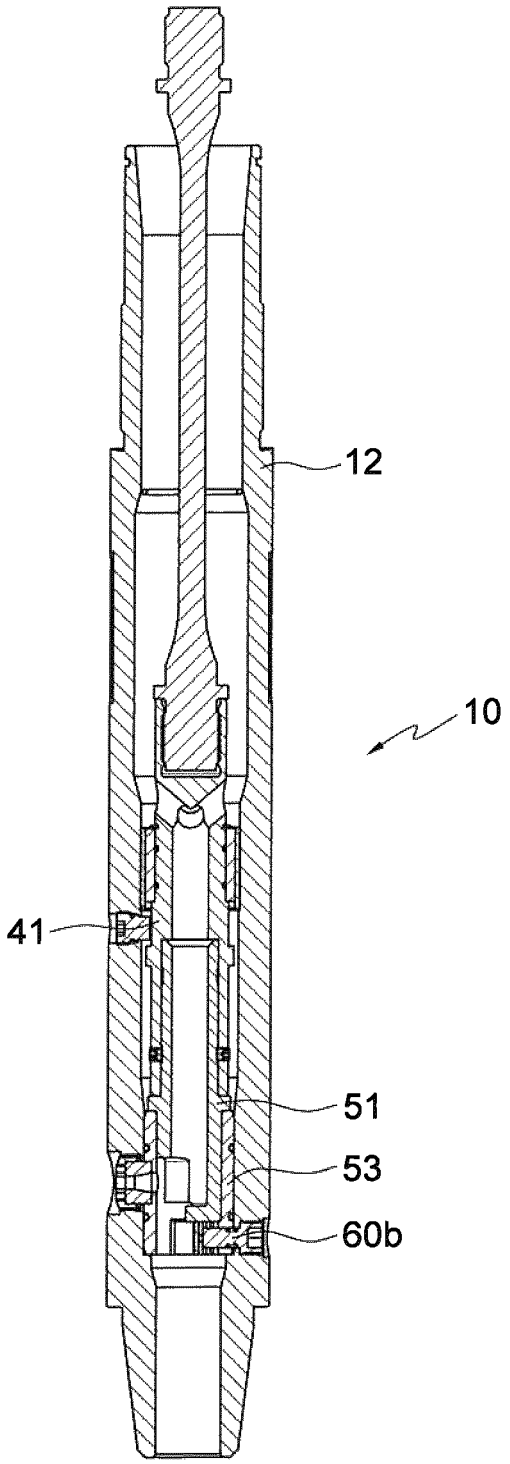
FIG. 8A is a cross sectional side view of the presently improved apparatus and methodologies, the fluid flow restrictor configured for a third setting of fluid flow restriction, according to embodiments.
Figure 8B:
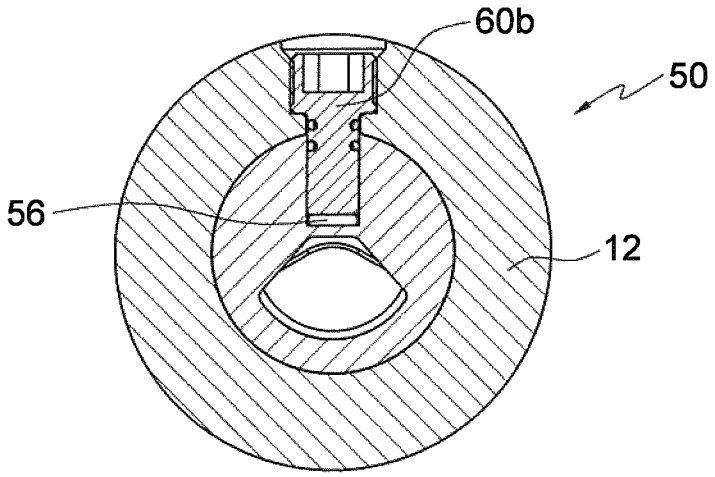
FIG. 8B is a top down cross sectional view of the fluid flow restrictor shown in 8A, according to embodiments.
Figure 9A:
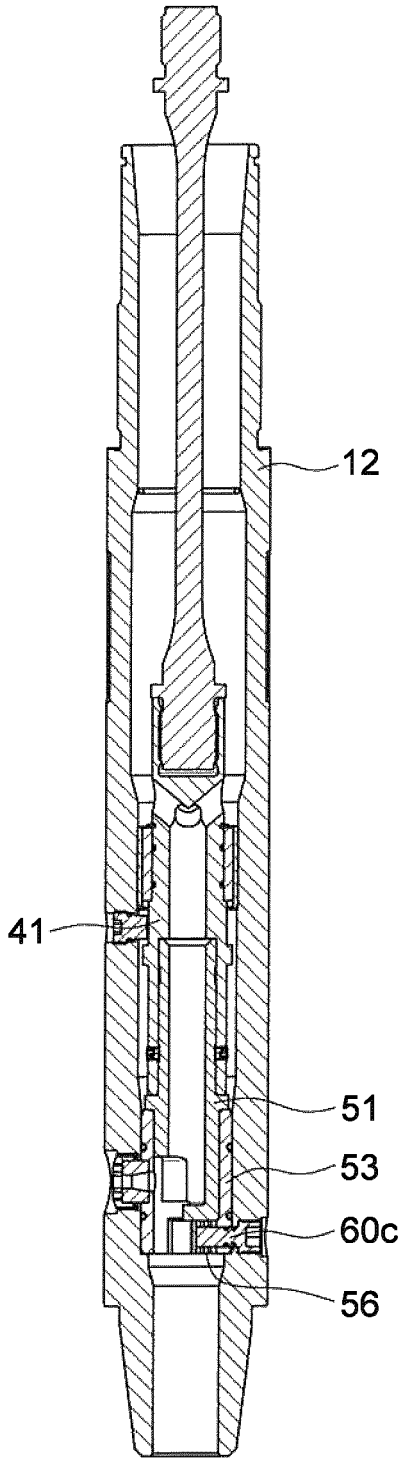
FIG. 9A is a cross sectional side view of the presently improved apparatus and methodologies, the fluid flow restrictor configured for a fourth 'closed' setting of fluid flow restriction, according to embodiments.
Figure 9B:
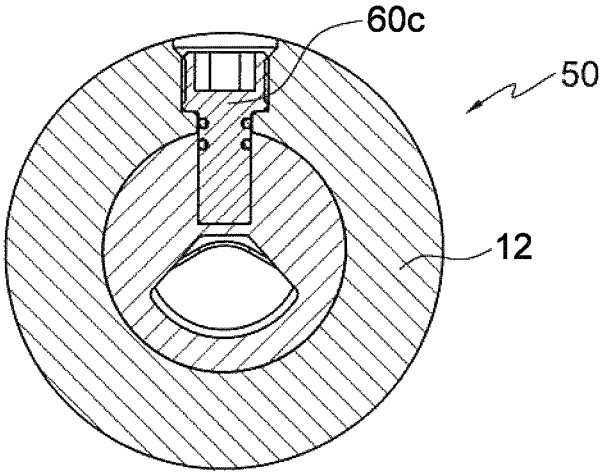
FIG. 9B is a top down cross sectional view of the fluid flow restrictor shown in 8A, according to embodiments.

Having regard to FIGS. 6B, 7B, 8B, and 9B, the present fluid flow restrictor 50 is shown in a plurality of operational settings ranging from at least one 'open' operation setting (FIG. 6B), whereby each of aperture and window 52,54 and groove and holes 55,56, respectively, are fully open to permit a maximal amount of fluid flow through the restrictor 50, to at least one other 'closed' setting, whereby groove and holes 55,56 are fully closed to restrict a maximal amount of fluid flow (FIG. 9B). That is, in one 'open' operation position, plug 60 may be positioned so as to minimally restrict the volume of fluid passing through plug groove 55 when holes 56 are aligned therewith. However, in other progressively more 'closed' operational positions, as shown in FIGS. 7B, 8B and 9B, plugs 60*a*, 60*b*, and 60*c*, respectively, may slidably received within groove 55 to plug one or more holes 56 (i.e., to prevent fluid from flowing through fluid exits formed in rotating disc 51), restricting the flow rate of larger volumes passing through restrictor 50. As will be described, each of the foregoing operational settings may be selected by an operator, on-site, based upon the drilling parameters and the desired pressure pulse. For example, in some embodiments, the at least one 'open' operation setting shown in FIG. 6B may be used to generate a pressure pulse as shown by Tune 1 in FIG. 10, whereas the at least one 'closed' operation setting shown in FIG. 9B may be used to generate a pressure pulse as shown by Tune 4 in FIG. 10.

In some embodiments, having regard to FIG. 7B, plug 60 may form a head portion 61 and a pin portion 62. Plug 60 may support at least one annular seal 64, such as an O-ring disposed about pin portion 62. Head 61 and pin 62 may be specifically configured for releasable positioning within groove 55. As will be described, in some embodiments, the specifications of head 61 and pin may vary depending upon the parameters selected by the operator, i.e., to control the amount of restriction presented to the fluid (hence to control the pressure drop across the valve and the rate of fluid flow through the valve).

For example, plug 60*a*,60*b*,60*c*, respectively, may be configured for fluid sealing engagement within groove 55, and may be sized so as to prohibit or plug fluid from flowing through holes 56. Depending upon the size and shape of plug 60*a*,60*b*,60*c* selected, operator may controllably prevent fluid flow through one or more holes 56 and may switch the tool between different performance parameters.

That is, in use, an operator may select and position a first plug 60 within groove 55 to provide a first 'open' performance parameter (FIG. 6A). Alternatively, an operator may select and position a full range of plugs 60*a*,60*b* to provide substantially or near-substantially 'closed' performance parameters (7B,8B). Finally, an operator may select and position a plug 60*c* to provide a 'closed' performance parameter (FIG. 9B), each of the foregoing performance parameters serving to generate a different pressure pulse of the tool 10 and corresponding vibration of the downhole apparatus. Varying plug 60 size (i.e., pin 62 length) causes plug 60 to extend deeper into groove 55, plugging more holes 56 within groove 55. It should be appreciated that, although four plugs 60,60*a*,60*b*,60*c*, are shown to demonstrate four performance settings of the present tool 10, any number of plugs 60*n* may be provided to support even more performance settings.

In this regard, when the plug 60*n* occupies the position shown in FIG. 6B, the fluid path through rotating and stationary discs 51,53 is in a fully open position in which fluid may pass through restrictor 50 to a maximum extent. In contrast, when the plug 60*n* occupies to the position shown in FIG. 9B, with pin 62 extending completely into groove 55, the fluid path through rotating and stationary discs 51,52 is interrupted as holes 56 are in a fully closed position. In this closed position, fluid flow through rotating and stationary discs 51,53 will only occur during alignment of aperture and window 52,54.

As above, the shape of the pressure pulse profiles generated by each of the operation settings of the present tool 10 can be selected by the operator on-site, enabling enhanced tuning of said pulses based upon the drilling parameters. As would be appreciated, by varying the area of the cross-section of the space the fluid flows through (i.e., the fluid flow paths), while maintaining the pump flow rate constant, the velocity of the fluid flowing through the apparatus 10 can be increased or decreased, as desired, to optimize the pressure pulse induced by the tool 10.

Figure 10:
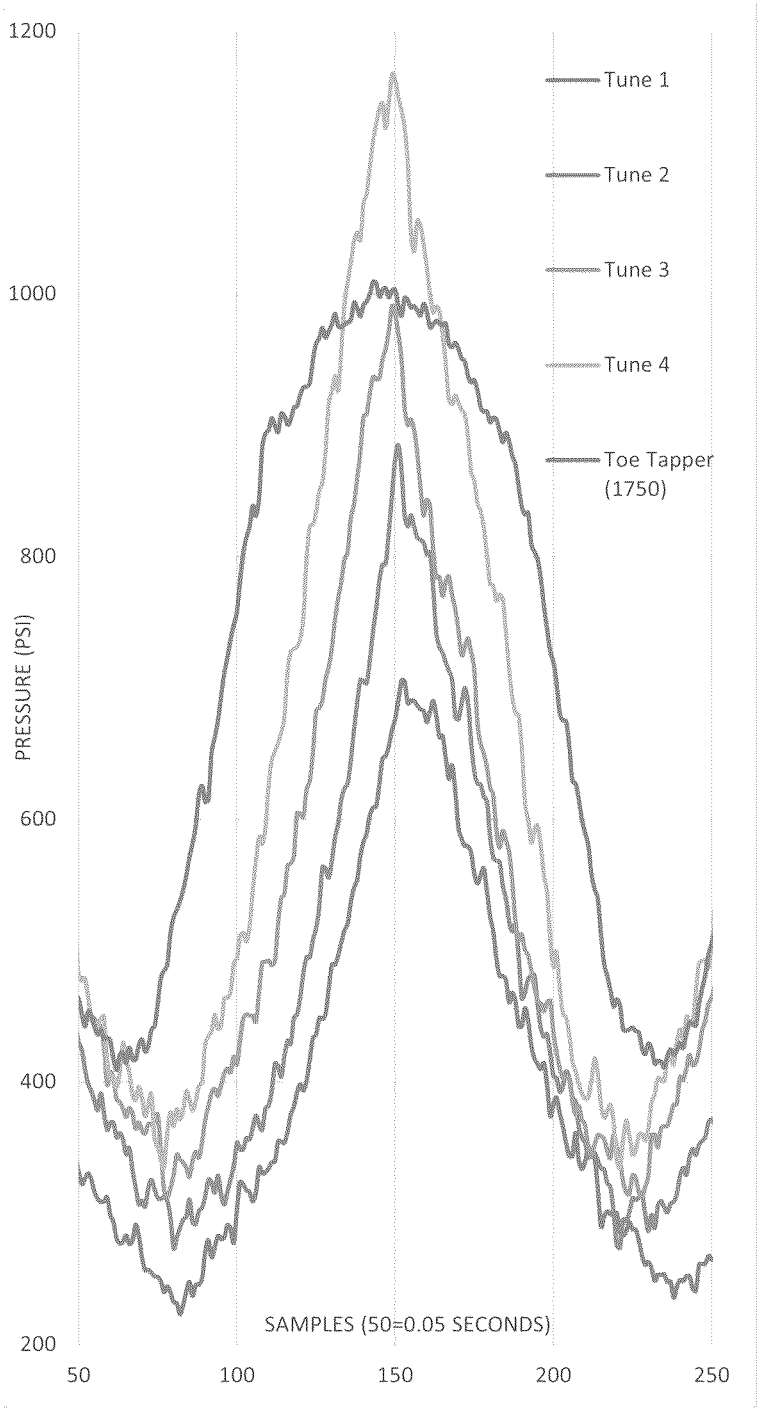
FIG. 10 shows a graphical representation of data highlighting an increase in pressure pulse amplitude achieved by the presently improved apparatus and methodologies.

Having regard to FIG. 10, pressure pulse profiles of the presently improved tool 10 (e.g., Tune 1, Tune, 2, Tune 3, and Tune 4) are exemplified by comparing the pulse to known pressure pulse tools, such as the Toe Tapper tool disclosed in the '464 patent (e.g., 'Toe Tapper'). Regardless of the particular performance setting that is selected, the pressure pulses induced by the present tool 10 achieve the desired pressure (psi) more quickly and efficiently (milliseconds) than known tools. Thus, by using the present fluid flow restrictor plug 60, an operator may select and change the desired pressure pulse generated by the present tool 10 based upon the drilling parameters experienced on-site, without altering pump rates and without having to dismantle and reassemble the tool 10. Each of the presently described operation settings serve to generate/achieve different pressure profiles, each profile demonstrating that the present tool is more efficient at producing impact forces with equivalent or near-equivalent pressure drops.

Various configurations of the present tool 10 are contemplated including varied positioning of the tool 10 along a drilling string, and/or where the tool 10 may be used alone or in combination with other negative pressure profile tools 10 in stacked arrangement, or in combination with one or more other downhole tools known in the art.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and the described portions thereof.

We claim:

1. A tool for inducing negative pressure pulses to a drilling-fluid transmitting downhole apparatus, the tool being adapted to controllably vary the passage of the drilling fluid, comprising:

a tubular housing having a cylindrical wall forming a central bore extending through the housing with an upper inlet end and a lower outlet end, and at least one fluid port and at least one plug hole disposed through the wall, a positive displacement motor, positioned within the bore of the housing, a fluid vent assembly, positioned within the bore of the housing, connected to and rotatable with the positive displacement motor, the fluid vent assembly having at least one second fluid port, at least one fluid flow restrictor, positioned within the bore of the housing, forming at least two fluid flow paths through the restrictor, and forming at least one groove aligned with the at least one plug hole, and at least one fluid flow restrictor plug, the plug having a least one head portion and at least one pin portion, the plug being adjustably positioned within the at least one plug hole to extend the pin portion within the at least one groove to plug at least one hole, causing the pin to controllably restrict fluid flow through at least one of the fluid flow paths of the fluid flow restrictor.

2. The tool of claim 1, wherein the at least one fluid flow restrictor plug is axially adjusted within at least one plug hole and the at least one groove to restrict different predetermined volumes of fluid flow through at least one of the at least two fluid flow paths of the fluid flow restrictor.

3. The tool of claim 2, wherein the at least one fluid flow restrictor plug is axially adjusted between at least one open setting, permitting a maximal amount of fluid flow through the at least one restrictor to at least one other closed setting, restricting a maximal amount of fluid flow through the at least one restrictor.

4. The tool of claim 2, wherein the at least one fluid flow restrictor plug is axially adjusted within the at least one fluid flow restrictor to generate different pressure pulse profiles.

5. The tool of claim 1, wherein the at least one fluid flow restrictor plug is adjusted to restrict fluid flow through one of the at least two fluid flow paths.

6. The tool of claim 1, wherein the at least one fluid flow restrictor comprises at least one rotating component and at least one stationary component and at least one stationary component.

7. The tool of claim 6, wherein the at least one rotating and stationary components form the at least two fluid flow paths.

8. The tool of claim 6, wherein the at least one rotating and stationary components and corresponding at least two fluid flow paths rotate into and out of alignment.

9. The tool of claim 1, wherein the drilling-fluid transmitting downhole apparatus comprises drill string, coil tubing, or casing string.

10. The tool of claim 1, wherein the tool is incorporated into the downhole apparatus.

11. The tool of claim 1, wherein the at least one fluid flow restrictor is positioned above, below, or within the fluid vent assembly.

12. A method of inducing a negative pressure pulse to a drilling fluid transmitting downhole apparatus, the method comprising:

providing fluid flow through a positive displacement motor positioned within a tubular housing within the apparatus, the housing having a cylindrical wall forming a central bore extending through the housing with an upper inlet end and a lower outlet end, and at least one fluid port and at least plug hole disposed through the wall, providing at least one fluid flow restrictor positioned within the central bore of the housing, having at least two fluid flow paths, and forming at least one groove aligned with the at least one plug hole, for controllably restricting the velocity of at least a portion of the fluid flow through the apparatus by passing the fluid flow through the at least one fluid flow restrictor, providing at least one fluid flow restrictor plug, the plug having at least one head portion and at least one pin portion, the plug being adjustably positioned within the at least one plug hole to extend the pin portion within the at least one groove and causing the pin to controllably restrict fluid flow through at least one of the fluid flow paths, and adjusting the position of the plug within the at least one plug hole to controllably increase fluid pressure within the tool, while recurrently venting at least a portion of the restricted fluid from the downhole apparatus through a fluid vent assembly to induce the pressure pulse.

13. The method of claim 12, wherein the adjusting of the at least one fluid flow restrictor plug restricts different predetermined volumes of fluid flow through at least one of the at least two fluid flow paths.

14. The method of claim 13, further comprising adjusting the at least one fluid flow restrictor plug between at least one open setting for permitting a maximal amount of fluid flow through the at least one fluid flow restrictor, and at least one other closed setting for restricting a maximal amount of fluid flow through the at least one fluid flow restrictor.

15. The method of claim 13, wherein the adjusting of the at least one fluid flow restrictor plug generates different pressure pulse profiles.

16. The method of claim 12, wherein the adjusting of the at least one fluid flow restrictor plug restricts fluid flow through one of the at least two fluid flow paths.

17. The method of claim 12, wherein the at least one fluid flow restrictor comprises at least one rotary component that rotates into and out of alignment with at least one stationary component.

18. The method of claim 17, wherein the at least one rotary and stationary components form the at least two fluid flow paths.

19. The method of claim 12, wherein adjusting the at least one fluid flow restrictor controllably dictates the velocity of fluid flowing through the at least one fluid flow restrictor.

20. The method of claim 12, wherein the manner of fluid flow restriction and venting dictate the amplitude and frequency of the pressure pulse.

* * * * *